US005193377A

United States Patent [19]

Sendzimir et al.

[11] Patent Number: 5,193,377

[45] Date of Patent: Mar. 16, 1993

[54] CROWN ADJUSTMENT SYSTEMS ON CLUSTER MILLS

[75] Inventors: Michael G. Sendzimir, Woodbury; John W. Turley, Oxford, both of Conn.

[73] Assignee: T. Sendzimir, Inc., Waterbury, Conn.

[21] Appl. No.: 748,962

[22] Filed: Aug. 23, 1991

[51] Int. Cl.[5] ..... B21B 13/14; B21B 29/00

[52] U.S. Cl. ..... 72/241.4; 72/242.4

[58] Field of Search ..... 72/240, 241.2, 241.4, 72/241.8, 242.2, 242.4, 248

[56] References Cited

U.S. PATENT DOCUMENTS

| | | | |
|---|---|---|---|
| 2,169,711 | 8/1939 | Sendzimir . | |
| 2,194,212 | 3/1940 | Sendzimir . | |
| 3,147,648 | 9/1964 | Sendzimir . | |
| 3,528,274 | 9/1970 | Rastelli | 72/242.4 |
| 3,657,913 | 4/1972 | Talbot | 72/242.4 |
| 3,858,424 | 1/1975 | Kajiwara et al. | 72/242.2 |
| 4,289,013 | 9/1981 | Hunke . | |

FOREIGN PATENT DOCUMENTS

| | | | |
|---|---|---|---|
| 0040358 | 4/1976 | Japan | 72/242.2 |

*Primary Examiner*—Lowell A. Larson
*Assistant Examiner*—Thomas C. Schoeffler
*Attorney, Agent, or Firm*—Frost & Jacobs

[57] ABSTRACT

A crown adjustment system for a 20-high (1-2-3-4) cluster mill of the type having upper and lower clusters each comprising a work roll, two first intermediate rolls, three second intermediate rolls, and four backing bearing assemblies. Each of the backing bearing assemblies of the upper cluster comprises a shaft supported along its length by saddles. Each of the saddles has a projecting ring through which the shaft passes. A plurality of bearing roll segments are journaled on the shaft between its respective saddle rings. A plurality of eccentrics are keyed to the shaft, each being located within one of the saddle rings supporting the shaft. Within the saddle ring of each saddle supporting the shaft there is an eccentric ring mounted on bearing rollers between its respective saddle ring and the adjacent keyed eccentric. The saddles of each of the shafts of the backing bearing assemblies of the upper cluster are equal in number and occupy the same saddle locations so that the saddles at corresponding saddle locations on adjacent shafts lie opposite each other. Those eccentric rings on the shafts of all four backing bearing assemblies of the upper cluster, which occupy the same saddle location, are interconnected by gears and are rotatable by a drive assembly at that saddle location. As a result, a single drive means for each saddle location can be used to effect the crown adjustment on all four backing bearing assemblies of the upper cluster.

9 Claims, 4 Drawing Sheets

CROWN ADJUSTMENT SYSTEMS ON CLUSTER MILLS

TECHNICAL FIELD

This invention relates to a crown adjustment system for use on Sendzimir and other cluster mills, and more particularly to such a system wherein all of the backing bearing shafts of the upper cluster can be bent to adjust the crown of the mill without increasing the number of drive elements therefor.

BACKGROUND ART

The crown adjustment system of the present invention is particularly applicable to a 20-high (1-2-3-4) cluster mill. For purposes of an exemplary showing, the crown adjustment system will be described in its application to such a 20-high (1-2-3-4) mill, although the system is not intended to be so limited, as will be apparent hereinafter.

Typically, a 20-high (1-2-3-4) cluster mill comprises an upper cluster and a lower cluster. The upper cluster comprises an upper work roll which is backed by two first intermediate rolls. The two first intermediate rolls are backed by three second intermediate rolls which, in turn, are backed by four backing bearing assemblies. The lower cluster is similar to the upper cluster, comprising a lower work roll, a pair of first intermediate rolls, three second intermediate rolls, and four backing bearing assemblies.

Each backing bearing assembly comprises bearing roll segments mounted upon a shaft with intermediate supports provided between the bearing roll segments and at the ends of the shaft. These supports are known as saddles, and the saddles for each shaft support the shaft against the mill housing.

In prior art 20-high (1-2-3-4) mills, crown adjustment is most commonly made by bending the shafts of the uppermost adjacent pair of backing bearing assemblies of the upper cluster. These shafts are bent into the desired crown shape, such as a parabolic shape, by adjusting the radial positions of the supports. This is commonly achieved by the use of eccentric rings, which can be rotated to achieve the desired adjustment as set forth in U.S. Pat. Nos. 2,169,711 and 2,194,212. The actual construction used on mills built since 1955 is shown in U.S. Pat. No. 3,147,648 and is described and illustrated in FIGS. 3-6 of U.S. Pat. No. 4,289,013.

Separate drives, comprising a set thereof, are provided at each saddle location of the uppermost adjacent pair of backing bearing assemblies to adjust the position of the shafts thereof. Although these drives may be individually operated, they are not completely independent because of the effect of the stiffness (in bending) of the shafts. If a drive is operated in such a manner as to produce excessive bending of the shafts, a high radial force will develop which will usually stall the drive as a result.

It is the object of the present invention to extend the range of crown control on 20-high (1-2-3-4) cluster mills by adjusting the shafts on at least four of the eight backing bearing assemblies (for example all four of the backing bearing assemblies of the upper cluster) without increasing the number of drive elements. Since four shafts (instead of two) are being bent, the effective crown at the roll gap will be greatly increased. Furthermore, for a given desired crown adjustment, the amount by which the shafts must be bent is markedly reduced.

DISCLOSURE OF THE INVENTION

According to the invention, there is provided a crown adjustment system for a 20-high (1-2-3-4) cluster mill of the type having upper and lower clusters each comprising a work roll, two first intermediate rolls, three second intermediate rolls, and four backing bearing assemblies. Each of the backing bearing assemblies of the upper cluster comprises a shaft supported against the mill housing at a plurality of locations along its length by saddles. Each of the saddles comprises a shoe portion abutting the mill housing and a projecting ring having a circular opening therein. The shaft passes through the openings of its respective saddle rings. A plurality of bearing roll segments are journaled on the shaft between its respective saddle rings. The shaft has a plurality of eccentrics keyed thereon, each keyed eccentric being located within the circular opening of one of the saddle rings supporting the shaft. Within the circular opening of the saddle ring of each saddle supporting the shaft there is an eccentric ring mounted on bearing rollers between its respective saddle ring and the adjacent keyed eccentric. Each eccentric ring has affixed thereto a pair of gear rings located to either side of its respective saddle ring. The saddles of each of the shafts of the backing bearing assemblies of the upper cluster are equal in number and occupy the same saddle locations so that the saddles at corresponding saddle locations on adjacent shafts lie opposite each other. Each pair of gear rings at each saddle location on the uppermost adjacent pair of backing bearing assemblies of the upper cluster have first and second sets of gear teeth formed thereon. A plurality of quadruple gear racks are provided. Each gear rack is located between opposed saddles of the uppermost adjacent pair of backing bearing assemblies of the upper cluster and has its gear teeth meshed with the first set of gear teeth of the pair of gear rings of each of the opposed saddles. Each pair of gear rings on the saddles of the outermost backing bearing assemblies of the upper cluster have a single set of gear teeth formed thereon. The second set of gear teeth on the gear rings of each saddle of the uppermost adjacent pair of backing bearing assemblies of the upper cluster are meshed with the single set of gear teeth of the gear rings of the opposed saddle in the same saddle location on the adjacent one of the outermost backing bearing assemblies of the upper cluster. As a result, translation of each of the quadruple racks by its respective drive means will result in rotation of the eccentric ring of that saddle of each of the backing bearing assemblies of the upper cluster occupying he saddle location controlled by that rack. Thus the racks can be used to bend the shafts of all four backing bearing assemblies of the upper cluster for purposes of crown adjustment. Means are also provided to lock the shafts of the outermost backing bearing assemblies of the upper cluster, to prevent them from rotating under load.

DETAILED DESCRIPTION OF THE INVENTION

Figure 5:
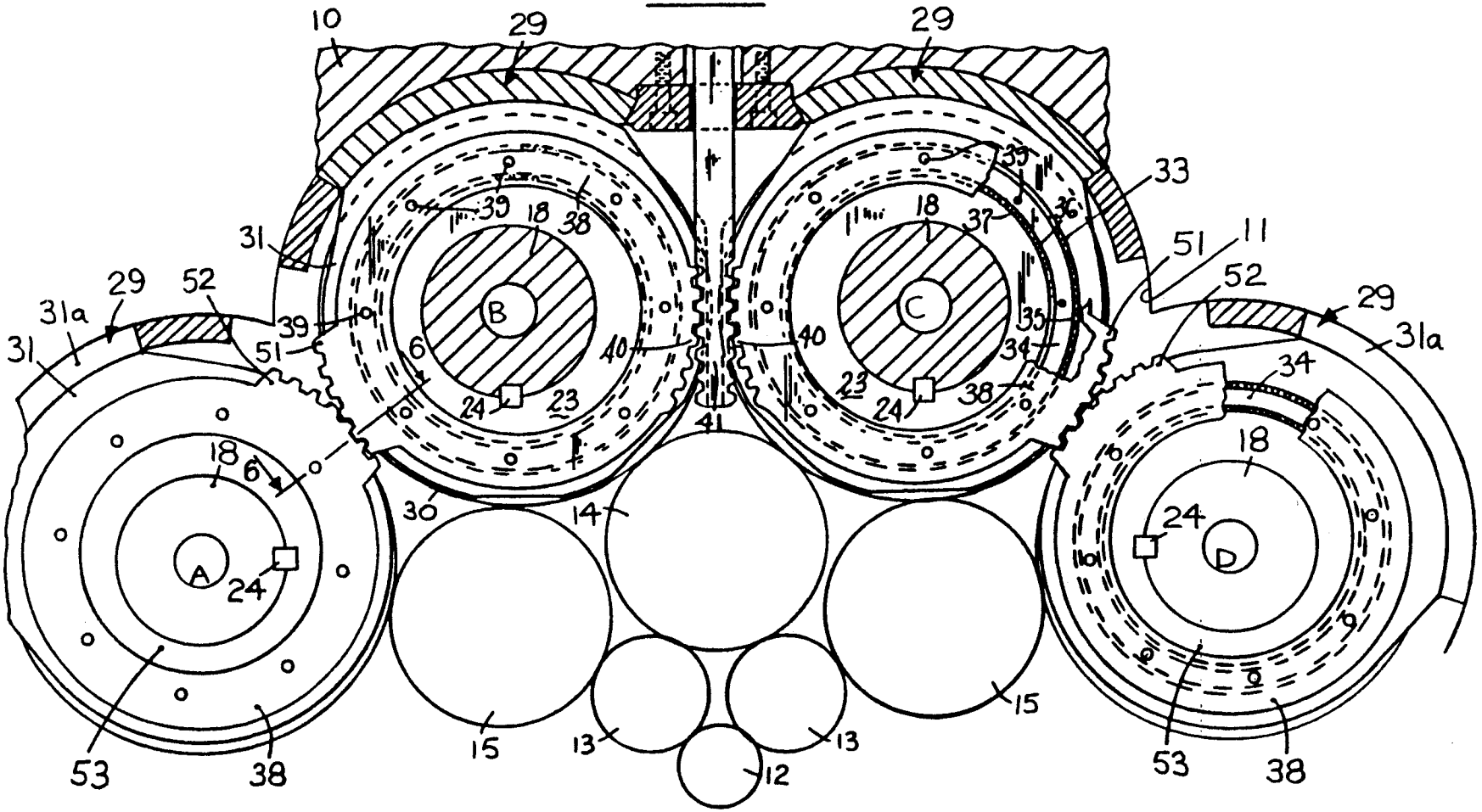
FIG. 5 is a fragmentary elevational view, partly in cross section, of the upper cluster of a 20-high mill according to the present invention.

FIG. 5 illustrates a typical upper cluster arrangement found in a Sendzimir 20-high (1-2-3-4) mill. A mill housing 10 is provided with a roll cavity 11, within which the upper and lower clusters are located. In the upper cluster, the four backing bearing assemblies A, B, C and D support three second intermediate rolls, the two outer ones 15 being driven, and the center one 14 being non-driven. The three second intermediate rolls, in turn, support two first intermediate rolls 13, which, in turn, support upper work roll 12. The lower cluster (not shown) is located beneath the upper cluster in roll cavity 11. The lower cluster, in principle, is an inverted arrangement similar to the upper cluster and comprises a lower work roll, two first intermediate rolls, three second intermediate rolls and four backing bearing assemblies. The strip is rolled by passing it between the upper and lower work rolls.

Figure 1:
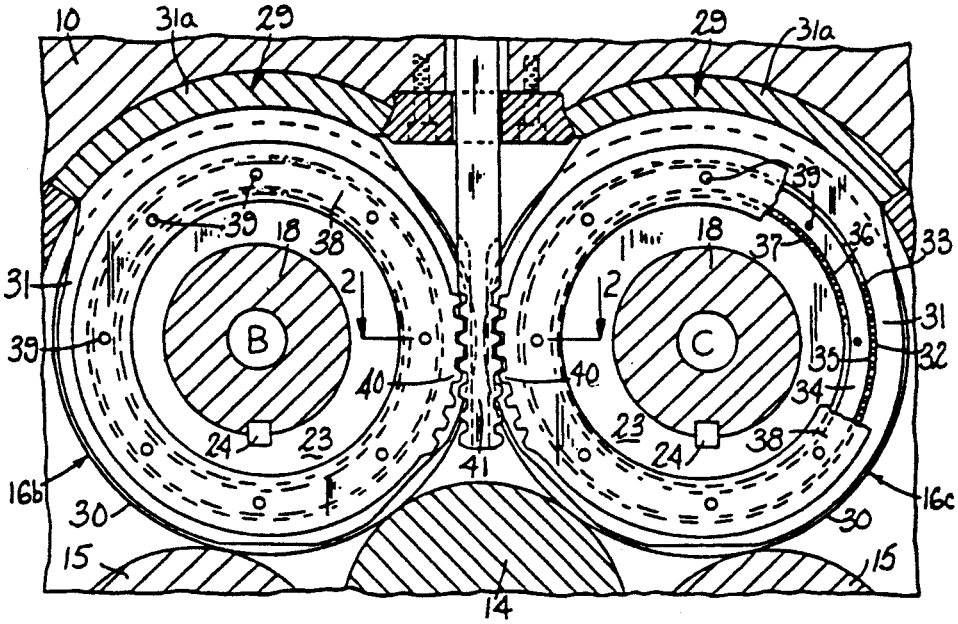
FIG. 1 PRIOR ART
FIG. 1 is a fragmentary vertical cross sectional view of the upper cluster of a 20-high mill according to the prior art, showing the top two backing bearing assemblies.
Figure 3:
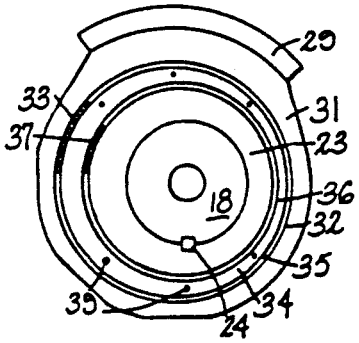
FIG. 3 PRIOR ART
FIG. 3 is a cross sectional view showing one saddle assembly according to the prior art.
Figure 4:
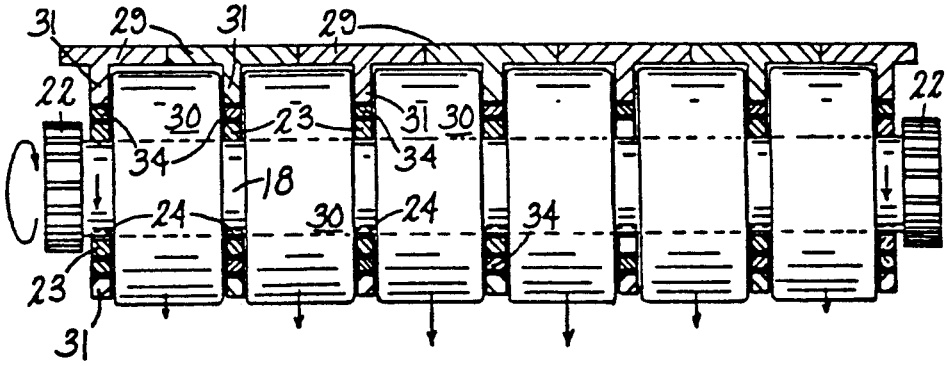
FIG. 4 PRIOR ART
FIG. 4 is a longitudinal cross sectional view of one of the top two backing bearing assemblies.

FIG. 1 is a fragmentary cross sectional view illustrating the uppermost adjacent pair of backing bearing assemblies B and C of the upper cluster of a prior art Sendzimir 20-high (1-2-3-4) mill. FIG. 4 is a longitudinal cross sectional view of the backing bearing assembly B. The backing bearing assembly B comprises a shaft 18 on which are rotatively mounted a plurality of bearing roll segments 30. In the embodiment illustrated, there are 6 such bearing roll segments 30. The shaft 18 is supported in the housing 10 by means of saddles 29. Each saddle 29 has a shoe portion 31*a* abutting mill housing 10 and a projecting flange or ring 31 (see also FIG. 3) having a circular opening therein defining an annular outer race 32 for bearing rollers 33. An eccentric ring 34 is located within each saddle ring opening and has an annular outer surface 35 which forms the inner race for the bearing rollers 33. Each of the eccentric rings 34 has an inner annular surface 36 which is eccentric relative to its outer surface 35 and forms an outer race for bearing rollers 37. Each saddle also supports a screwdown eccentric 23, the outer surface of which forms the inner race for bearing rollers 37. Each screwdown eccentric 23 has a circular opening through which the shaft 18 extends. The circular opening is eccentric with respect to the peripheral surface of the screwdown eccentric. Each of the screwdown eccentrics is keyed to the shaft 18 as at 24 (see FIG. 3).

It will be evident from the above description that each eccentric ring 34 is rotatively mounted in its respective saddle ring 31 using bearing rollers 33 to achieve low friction. Similarly, each screwdown eccentric 23, to which the shaft 18 is keyed, is rotatively mounted in its respective eccentric ring 34, using bearing rollers 37 to achieve low friction. The eccentric rings 34 are so called because their outside diameters are eccentric with respect to their inside diameters, as indicated above. Therefore, as each eccentric ring 34 is rotated, assuming that its respective saddle 29 is fixed in place in mill housing 10, a displacement of shaft 18 (upon which bearing roll segments 30 are mounted) will result.

Figure 2:
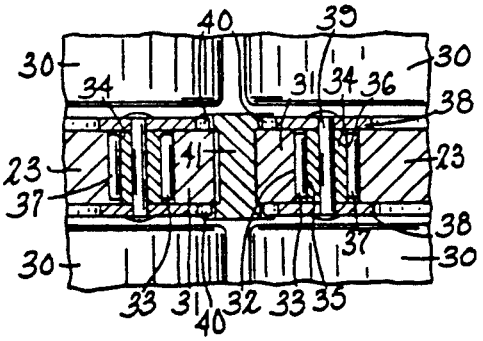
FIG. 2 PRIOR ART
FIG. 2 is a fragmentary cross sectional view taken along a section line 2—2 of FIG. 1 and showing the details of crown adjustment gear/rack engagement according to the prior art.

As is most clearly shown in FIGS. 1 and 2, the eccentric ring 34 within each saddle ring 31 is maintained in proper axial position by a pair of gear rings 38 on which gear teeth 40 are cut. The gear rings 38 lie to either side of the saddle ring 31 and are attached to their respective eccentric ring 34 by means of rivets 39. As will be evident from FIG. 4, there are seven saddles for the backing bearing assembly B, each saddle having its ring 31 containing an eccentric ring 34 and a screwdown eccentric 23. In FIG. 4, for purposes of clarity, gear rings 38 have been deleted.

It will be understood that the backing bearing assembly C is of similar construction, and like parts have been given like index numerals. When the backing bearing assemblies B and C are properly mounted within the mill housing 10, their saddles 29 and saddle rings 31 will lie directly opposite each other at each saddle position. This is clearly shown in FIGS. 1 and 2. As a consequence, the gear rings 38 of corresponding saddle rings of backing bearing assemblies B and C will lie opposite each other, again as is illustrated in FIG. 2. The gear teeth 40 of each of the corresponding pairs of gear rings 38 are engaged by a quadruple gear rack 41, one of which is shown in each of FIGS. 1 and 2. Since the gear rack 41 has four sets of gear teeth, two sets engaging the teeth 40 of the two gear rings 38 on the adjacent saddle of the backing bearing assembly B, and two sets engaging the teeth 40 of the two gear rings 38 on the adjacent saddle of the backing bearing assembly C, translating the rack 41 will cause the respective gear rings 38 and eccentric rings 34 to rotate, thus displacing the shafts 18 of both of the backing bearing assemblies B and C.

It will be understood that there will be seven quadruple gear racks 41, one for each adjacent corresponding pair of saddles 29 on backing bearing assemblies B and C. By moving the racks with the correct relationship, it is possible to tilt or bend the shafts 18 of the backing bearing assemblies B and C, to adjust the crown of the mill. A drive (not shown) comprising a motorized screw jack or a hydraulic cylinder is used to translate each of the quadruple gear racks 41.

Screw down, to adjust the gap of the work rolls, is affected by rotating the shafts 18 of back up bearing assemblies B and C together with the seven screwdown eccentrics 23 keyed to each shaft. To this end, the shafts 18 of backup bearing assemblies B and C are provided with gears 22 (see FIG. 4) which are keyed to their respective shafts at the ends thereof. Two racks (not shown), actuated by hydraulic cylinder means (not shown), are provided. One of the racks rotates the adjacent gears 22 at one end of the shafts 18 of backing bearing assemblies B and C. The other rack rotates the adjacent gears 22 at the other end of the shafts 18 of backing bearing assemblies B and C.

It will be remembered that each of the shafts 18 of backup bearing assemblies B and C have seven screwdown eccentrics 23 keyed thereto. The outside diameters of the screwdown eccentrics 23 are eccentric relative to their inside diameters. The screwdown eccentrics 23 of each of the shafts 18 are mounted thereon in phase, i.e., with the same radial orientation. Therefore, as the screwdown racks (not shown) are actuated, resulting in rotation of the shafts 18 of backup bearing assemblies B and C and the screwdown eccentrics mounted thereon, the entire B and C shaft centers translate. This has the effect of increasing or decreasing the roll gap of the mill.

The above described apparatus for crown adjustment and for screwdown adjustment are well known in the art, having been used on most Sendzimir 20-high (1-2-3-4) mills built since 1955, both in the United States and in foreign countries.

In the prior art mills, the crown adjustment is effected on the two inner backing bearing assemblies B and C only. Eccentric rings 34 and bearing rollers 33 and 37 are used only in these two backing bearing assemblies. The other backing bearing assemblies (i.e., the two outer backing bearing assemblies of the upper cluster and the four backing bearing assemblies of the lower cluster) do, however, have eccentrics corresponding to the screwdown eccentrics on backing bearing assemblies B and C. For the pair of inner backing bearing assemblies of the lower cluster, these eccentrics are used for pass line height adjustment using a rack and gear and hydraulic cylinder to make the adjustment. For the outer backing bearing assemblies both of the upper cluster and the lower cluster, the eccentrics are used to adjust the roll gap to compensate for roll wear, and an electric or hydraulic motor drive with reduction gears is used to make the adjustment by driving a pinion which meshes with the gears mounted on the ends of their shafts 18.

It should be noted that only the backing bearing assemblies B and C have saddles with bearing rollers and therefore adjustment under load can be made only on these two backing bearing assemblies. The other six backing bearing assemblies have plain saddles (i.e., they have no bearing rollers between their eccentrics and their saddles), with the result that adjustments can only be made under no load conditions. Therefore, the adjustment drives for these six backing bearing assemblies can be of relatively light construction.

Figure 6:
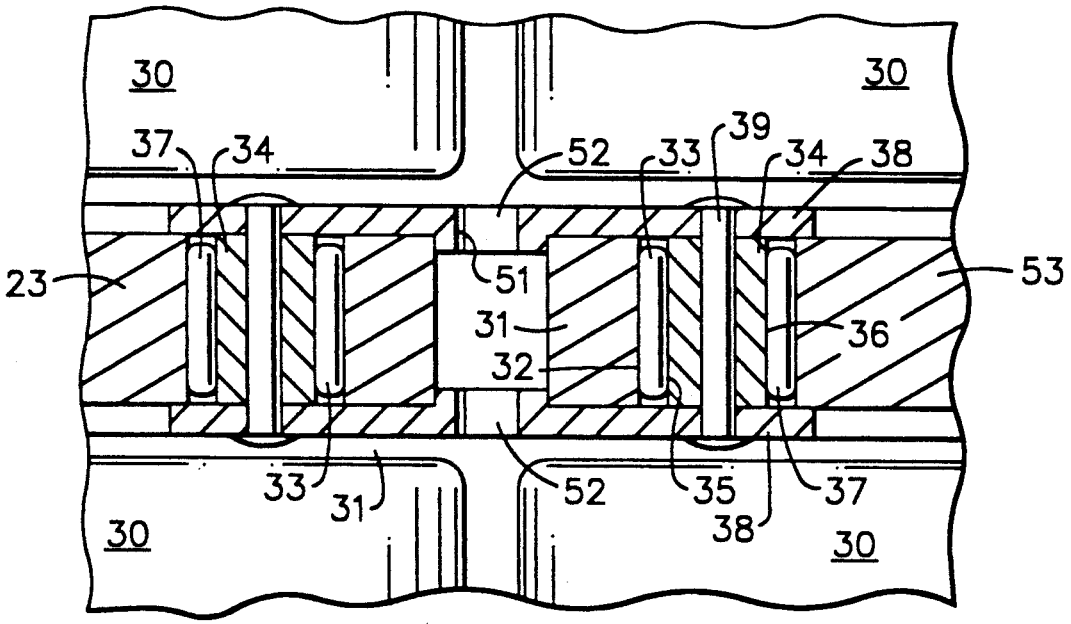
FIG. 6 is a fragmentary horizontal cross sectional view taken along section line 6—6 of FIG. 5.
Figure 7:
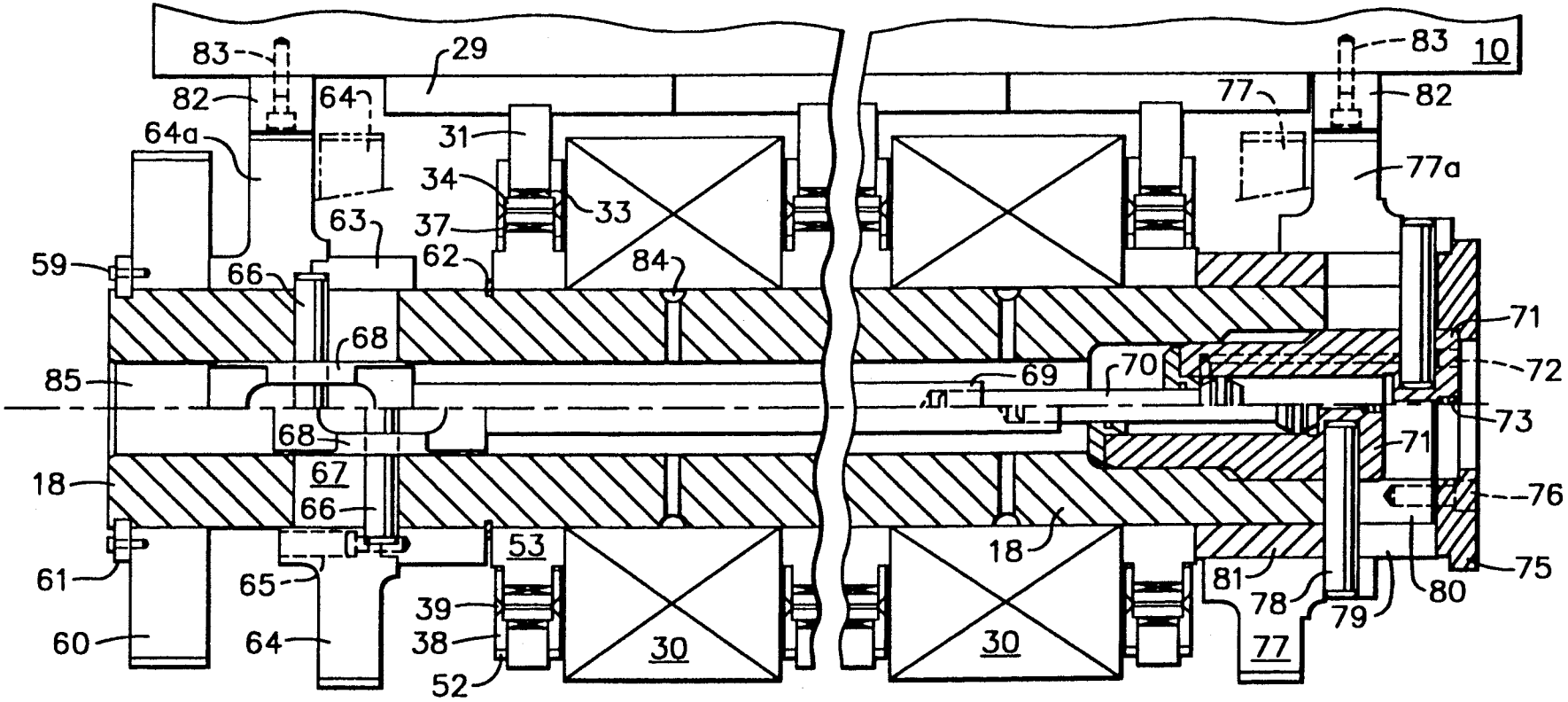
FIG. 7 is a fragmentary, longitudinal cross sectional view of one of the outer backing bearing assemblies of the present invention.

The crown adjustment system of the present invention is illustrated in FIGS. 5, 6 and 7. Turning first to FIG. 5, the adjacent uppermost pair of backing bearing assemblies B and C of the upper cluster are, with one exception, identical to those described with respect to FIG. 1, and like parts have been given like index numerals. The exception resides in the fact that each of the gear rings 38 are provided with a second set of gear teeth 51. The purpose of gear teeth 51 will be apparent hereinafter.

The crown adjustment system of the present invention also requires modification of the outer backing bearing assemblies A and D of the upper cluster. The outer backing bearing assemblies A and D each comprise a shaft 18 with eccentrics 53 keyed thereto as at 24. The shaft 18 carries bearing roll segments 30 (see FIG. 6). The shafts 18 of the outer backing bearing assemblies A and D are supported by saddles 29 similar to the saddles 29 of the backing bearing assemblies B and C. Each ring 31 of the saddles 29 also carries an eccentric ring 34, together with bearing rollers 33 and 37. Each of the eccentric rings 34 of the outer backing bearing assemblies A and D has affixed thereto by rivets 39 a pair of gear rings 38 provided with gear teeth 52. As is clearly shown in FIGS. 5 and 6, the gear teeth 52 are adapted to mesh with the gear teeth 51 of the gear rings 38 of backing bearing assemblies B and C.

Thus, as the crown adjustment racks 41 are translated, rotation of eccentric rings 34 on backing bearing assemblies A, B, C and D is achieved. It is envisaged that the eccentricity of the eccentric rings 34 of the backing bearing assemblies A and D will be substantially the same as the eccentricity of the eccentric rings 34 of backing bearing assemblies B and C.

As the crown adjustment racks are translated to produce a crown form in the mill, not only will the shafts 18 of the backing bearing assemblies B and C be bent to the desired profile, but also the shafts 18 of backing bearing assemblies A and D will be bent substantially to the same profile. It should be understood that the eccentric rings 34 will be oriented so that, at mid-stroke, the plane of bending of the shafts 18 of backing bearing assemblies B and C will be substantially vertical, and the plane of bending of the shafts 18 of backing bearing assemblies A and D will be close to horizontal, such respective bending planes causing maximum effect at the roll gap.

As a result of the construction illustrated in FIGS. 5 and 6, for a given shaft bending deflection, the effective crown at the roll gap will be approximately double what it was when the crown adjustment was applied to the shafts 18 of backing bearing assemblies B and C only, and this improvement will have been obtained without the requirement for additional drives. The present invention also increases the range of roll gap control and decreases the amount by which each of the shafts 18 of backing bearing assemblies B and C must be bent to achieve a predetermined roll gap. The present invention results in a major improvement in the ability of the mill to roll flat strip.

In order to complete the invention, one further step is required. It is necessary to lock the shafts 18 of the backing bearing assemblies A and D to prevent their rotation when the mill is under load. Unlike the shafts 18 of the backing bearing assemblies B and C, which are provided with gears 22 at each end, with powerful servo-positioned hydraulic cylinders, acting via racks engaging the gears 22 at each end, providing the necessary resistance to prevent rotation when the mill is under load, the shafts 18 of the backing bearing assemblies A and D are usually provided with a lighter gear at the back end only, and a light drive is provided to rotate these shafts under no-load conditions only. When prior art saddles of the type described above for the shafts 18 of backing bearing assemblies other than B and C are used on the shafts 18 of backing bearing assemblies A and D, the eccentrics 53 will not rotate under load (i.e, they are self-locking) because, as there are no bearing rollers between the saddle bore and the eccentric ring, the friction between the outside peripheral surface of the eccentric and the saddle bore is too high to permit rotation. Thus, the shafts 18 of backing bearing assemblies A and D are effectively locked against rotation at each saddle.

However, since the present invention incorporates saddles provided with bearing rollers 33 and 37 on the shafts 18 of backing bearing assemblies A and D, these shafts will tend to rotate in a direction away from the load, these shafts and eccentrics 53 turning on bearing rollers 37, the eccentric ring 34 remaining stationary. The relatively light electric drives provided for the shafts 18 of backing bearing assemblies A and D are not sufficiently strong to prevent eccentric rotation, and even if they were, they would lock the shafts only at one end, so that the shafts would tend to twist under the action of the load.

FIG. 7 is a fragmentary, longitudinal cross sectional view through backing bearing assembly D, and illustrates a shaft rotation lock according to one embodiment of the present invention. It will be understood by one skilled in the art that a description of the shaft rotation lock in connection with backing bearing assembly D can be considered a description of a shaft rotation lock applied to the backing bearing assembly A as well.

In FIG. 7 shaft 18 is mounted within roller saddle assemblies 29 each having a saddle flange or ring 31, an eccentric ring 34, bearing rollers 33 and 37, crown adjusting gear rings 38, with gear teeth 52, which are attached to the eccentric ring 34 by rivets 39, and an eccentric 53, which is keyed to shaft 18, (the keys are not shown, for the sake of clarity). This saddle assembly construction is substantially according to the prior art construction used on the shafts of backing bearing assemblies B and C.

Gear 60 is keyed to one end (usually the back end) of shaft 18 (key not shown, for clarity) and is retained axially by split ring 61 which locates in a corresponding groove in shaft 18, and is attached to gear 60 by screws 59. The gear 60 engages with a pinion (not shown) and is used to rotate shaft 18 under no-load conditions only, to increase or decrease the roll gap by the action of eccentrics 53. It should be noted that gears 60 are provided with the same eccentricity as eccentrics 53, so they rotate concentrically. This adjustment, known as the side eccentric adjustment, is used primarily to compensate for roll wear, and is well known in the prior art.

The method of mounting the saddle assemblies on the shaft is also substantially according to the prior art. A snap ring 62 is fitted in a groove in shaft 18, and the parts are slid onto the shaft from the front first a key, then a saddle assembly to fit over the key (the key is used to set the orientation of eccentric 53), then a bearing roll segment 30 (no key), then the next key, then the next saddle assembly to fit over this key, and so on until the last (front) saddle assembly is mounted. Then keyed spacer ring 81 is slid on, and finally retainer plate 75 is mounted using bolts 76 to clamp all the parts tightly against snap ring 62.

The shaft rotation lock of the present invention works by means of a hydraulic cylinder which can be used to engage and disengage locking gears 64 and 77 with stationary mating annular gear sectors 82 bolted and dowelled to the mill housing 10. The engaged position is shown in the upper half of FIG. 7 and the disengaged position is shown in the lower half of FIG. 7.

Hydraulic cylinder 71, with its piston/piston rod 70, is slidably mounted in an axial bore in shaft 18. The piston/piston rod 70 is attached to extension rod 69 by a threaded engagement. The other end of extension rod 69 is provided with boss 68 which is guided on the axis of shaft 18 by sliding in the bore of the shaft. Transverse rod 66 is used to pin the boss to gear 64, ring 63 being attached to gear 64 by means of screws 65 securing the rod to the gear. Gear 64 is keyed to shaft 18 (key not shown), and slots 67 are provided in shaft 18 to enable gear 64, rod 66 and boss 68 to slide together in an axial direction, so that gear 64 moves into engagement with stationary annular gear sector 82 as shown at 64*a*, in the upper half of FIG. 7, or out of engagement, as shown at 64, in the lower half of FIG. 7, and also as shown in phantom lines at 64 in the upper half of FIG. 7.

It should be noted that boss 68 is shaped to enable bearing lubrication oil to flow past it from hole 85 through to radial oil supply holes 84 feeding each bearing roll segment.

Two radial pins 78, mounted axially in line with each other, are fitted in hydraulic cylinder 71, and pass through slots 80 in shaft 18, and slots 79 in spacer ring 81, and engage with gear 77, which is also keyed to spacer ring 81 (key not shown for clarity). Hydraulic oil connections are made to ports 72 (rod end) and 73 (head end) of the hydraulic cylinder.

Hydraulic cylinder 71, pins 78 and gear 77 are thus able to slide axially back and forth along shaft 18, so that gear 77 moves into engagement with stationary annular gear sector 82 as shown at 77*a* in the upper half of FIG. 7, or out of engagement as shown at 77 in the lower half of FIG. 7 and also as shown in phantom lines at 77 in the top half of FIG. 7.

If hydraulic oil under pressure is supplied to port 72, and port 73 is connected to tank, then piston 70 will be retracted and gears 64 and 77 will move out of engagement with annular gear sectors 82. This adjustment is only done when there is no load on the mill. Adjustment of the side eccentrics can then be made by rotating gear 60, which, of course, rotates the entire assembly of shaft 18, eccentrics 53, gears 64 and 77, cylinder 71, spacer ring 81, retainer plate 75 and associated parts.

If hydraulic oil under pressure is supplied to port 73, and port 72 is connected to tank, then piston 70 will be extended and gears 64 and 77 will move into engagement with annular gear sectors 82. To facilitate this engagement, it is envisaged that gears 64 and 77 and annular gear sectors 82 will be provided with rounded ends on their gear teeth. Furthermore, since there are only a finite number of angular positions of gear 60 for which the teeth on gears 64 and 77 will line up with corresponding gear tooth spaces on annular gear sectors 82, it is possible to interlock electrically to prevent attempts to engage these gears unless gear 60 is rotated to one of these positions. For example, if gears 64 and 77 have 180 teeth, then there are only 91 possible angular positions (from 0° to 180° at 2° increments) in the normal 180° adjustment range of gear 60, for which smooth engagement will occur.

It should be noted that, during manufacture of the parts, care must be taken to ensure that the teeth in gear 77 are in line with teeth on gear 64, and that the teeth on the two annular gear sectors 82 are in line with each other. The parts must be toleranced to ensure this.

It should be further noted that, whether the shaft rotation locking gears 64 and 67 are engaged or disengaged with annular gear sectors 82, it is always possible to operate the crown adjustment of our invention, because locking the shafts 18 and eccentrics 53 does not prevent the rotation of eccentric rings 34 and gear rings 38.

Modifications may be made in the invention without departing from the spirit of it. For example, it would be within the scope of the invention to apply the teachings of this invention to the backing bearing assemblies of the lower cluster of a cluster mill.

While the invention has been described in its application to a 20-high (1-2-3-4) mill, with proper modifications within the skill of the worker in the art, the invention could be applied to other mills such as a 12-high mill.

What is claimed is:

1. A crown adjustment system for a 20-high (1-2-3-4) cluster mill having a mill housing with a roll cavity containing upper and lower clusters, each of said clusters comprising a work roll, two first intermediate rolls, three second intermediate rolls, and four backing bearing assemblies, each of said backing bearing assemblies of said upper cluster comprising a shaft supported against said mill housing at a plurality of locations along its length by saddles, said saddles of each of said shafts of said backing bearing assemblies of said upper cluster being equal in number and occupying the same saddle locations so that those saddles at corresponding saddle locations on adjacent ones of said shafts lie opposite each other; crown adjustment means being provided at each saddle of each of said backing bearing assemblies of said upper cluster, means operatively interconnecting said crown adjustment means of all four backing bearing assemblies of said upper cluster which occupy the same saddle location, a single drive means for each saddle location to simultaneously actuate said crown adjustment means occupying that saddle location in all four of said backing bearing assemblies of said upper cluster, whereby said single drive means at each saddle location can be used to effect the crown adjustment on all four of said backing bearing assemblies of said upper cluster.

2. The crown adjustment system claimed in claim 1 wherein each of said backing bearing assemblies of said lower cluster comprises a shaft supported against said mill housing at a plurality of locations along its length by saddles, said saddles of each of said shafts of said backing bearing assemblies of said lower cluster being equal in number and occupying the same saddle locations so that those saddles at corresponding saddle locations on adjacent ones of said shafts lie opposite each other; crown adjustment means being provided at each saddle of each of said backing bearing assemblies of said lower cluster, means operatively interconnecting said crown adjustment means of all four backing bearing assemblies of said lower cluster which occupy the same saddle location, a single drive means for each saddle location to simultaneously actuate said crown adjustment means occupying that saddle location in all four of said backing bearing assemblies of said lower cluster whereby said single drive means at each saddle location can be used to effect the crown adjustment on all four of said backing bearing assemblies of said lower cluster.

3. The crown adjustment system claimed in claim 1 including means for locking said shafts of said outermost pair of backing bearing assemblies of said upper cluster against rotation when said mill is placed under load.

4. The crown adjustment system claimed in claim 3 wherein said locking means for each of said shafts of said outermost pair of backing bearing assemblies comprises a pair of gears, each located near an end of said shaft, said gears being keyed to and axially slidable on said shaft, a pair of corresponding annular gear sectors affixed to said mill housing, and means to shift said gears along said shaft between a locking position wherein each of said gears is meshed with one of said gear sectors, and a non-locking position wherein said gears are spaced from their respective gear sectors.

5. The crown adjustment system claimed in claim 1 wherein, in each of said backing bearing assemblies of said upper cluster, each saddle comprises a shoe portion abutting said mill housing and a projecting ring having a circular opening therein through which said shaft passes, a plurality of eccentrics being keyed to said shaft, each keyed eccentric being located within said circular opening of one of said saddle rings supporting said shaft, said crown adjustment means at each saddle comprising an eccentric ring located within said circular opening of each saddle ring supporting said shaft, each eccentric ring being mounted on bearing rollers between its respective saddle ring and the adjacent keyed eccentric, said interconnecting means comprising a pair of gear rings affixed to each eccentric ring and located to either side of its respective saddle ring, said gear rings of each saddle of said uppermost adjacent pair of backing bearing assemblies of said upper cluster having first and second sets of gear teeth formed thereon, said gear rings of each saddle of said outermost pair of backing bearing assemblies of said upper cluster having a single set of gear teeth formed thereon, the single set of teeth of the gear ring of each saddle of said outermost pair of backing bearing assemblies being meshed with said second set of gear teeth of the gear rings of the adjacent one of said saddles in the same saddle location on the adjacent one of said uppermost adjacent pair of backing bearing assemblies, said single drive means for each saddle location comprising a quadruple gear rack between said uppermost adjacent pair of backing bearing assemblies at said saddle location, said first set of gear teeth of said gear rings of each saddle of said uppermost adjacent pair of backing bearing assemblies being meshed with one of said racks of said quadruple gear rack located at the same saddle location.

6. The crown adjustment system claimed in claim 5 including means for locking said shafts of said outermost pair of backing bearing assemblies of said upper cluster against rotation when said mill is placed under load.

7. The crown adjustment system claimed in claim 6 wherein said locking means for each of said shafts of said outermost pair of backing bearing assemblies comprises a pair of gears, each located near an end of said shaft, said gears being keyed to and axially slidable on said shaft, a pair of corresponding annular gear sectors affixed to said mill housing, and means to shift said gears along said shaft between a locking position wherein each of said gears is meshed with one of said gear sectors, and a non-locking position wherein said gears are spaced from their respective gear sectors.

8. A backing bearing assembly for a 20-high (1-2-3-4) cluster mill having a mill housing with a roll cavity containing upper and lower clusters, said backing bearing assembly comprising a shaft supported against said mill housing at a plurality of locations along its length by saddles, each saddle comprising a shoe portion abutting said mill housing and a projecting ring having a circular opening therein through which said shaft passes, a plurality of eccentrics being keyed to said shaft, each keyed eccentric being located within said circular opening of one of said saddle rings supporting said shaft, an eccentric ring located within said circular opening of each saddle ring supporting said shaft, each eccentric ring being mounted on bearing rollers between its respective saddle ring and the adjacent keyed eccentric, and means to lock said shaft of said backing bearing assembly to prevent its rotation under load, said locking means comprising a pair of locking gears, each locking gear of said pair being keyed to and axially slidable on said shaft near an end thereof, a pair of corresponding annular gear sectors affixed to said mill housing within said roll cavity thereof adjacent said locking gears, and means to axially shift said locking gears between a locking position wherein each locking gear is meshed with its respective gear sector and an unlocking position wherein said locking gears are free of their respective gear sectors.

9. The backing bearing means claimed in claim 8 wherein said means to shift said locking gears axially with respect to said shaft between locking and unlocking positions comprise a hydraulic cylinder and piston/-piston rod assembly slidably mounted within an axial bore in said shaft and operatively attached to said locking gears.

* * * * *